US010638852B2

(12) United States Patent
Downes et al.

(10) Patent No.: US 10,638,852 B2
(45) Date of Patent: May 5, 2020

(54) BEDSHEET-HOLDER

(71) Applicants: Kimberly K. Downes, Wanaque, NJ (US); Robert Downes, Wanaque, NJ (US)

(72) Inventors: Kimberly K. Downes, Wanaque, NJ (US); Robert Downes, Wanaque, NJ (US)

( * ) Notice: Subject to any disclaimer, the term of this patent is extended or adjusted under 35 U.S.C. 154(b) by 26 days.

(21) Appl. No.: 16/173,251

(22) Filed: Oct. 29, 2018

(65) Prior Publication Data

US 2019/0125091 A1 May 2, 2019

Related U.S. Application Data

(60) Provisional application No. 62/578,088, filed on Oct. 27, 2017.

(51) Int. Cl.
*A47C 21/02* (2006.01)

(52) U.S. Cl.
CPC ..... *A47C 21/022* (2013.01)

(58) Field of Classification Search
CPC ..... A47C 21/022; Y10T 24/23; Y10T 24/318
See application file for complete search history.

(56) References Cited

U.S. PATENT DOCUMENTS

| | | | | |
|---|---|---|---|---|
| 373,424 | A * | 11/1887 | Murray | A47C 21/022 24/72.5 |
| 875,359 | A * | 12/1907 | Lazaro | A47C 21/022 24/72.5 |
| 2,769,989 | A | 11/1956 | Woodford | |
| 3,296,668 | A | 1/1967 | Aiken | |
| 4,662,016 | A | 5/1987 | Seeman | |
| 4,829,617 | A | 5/1989 | Dameron | |
| 5,404,602 | A | 4/1995 | Kondo | |

* cited by examiner

*Primary Examiner* — Robert Sandy
(74) *Attorney, Agent, or Firm* — Boudwin Intellectual Property

(57) ABSTRACT

A bedsheet-holder for securing bedding materials together when in use on a mattress. The bedsheet-holder includes an elongated flexible member having a first end and a second end designed to secure a plurality of bedding materials in place. A plurality of fasteners positioned along the length of the elongated member are designed to secure the elongated member to the plurality of bedding materials, such that the plurality of bedding materials remain attached to one another and are prevented from falling off of a bed when in use. The bedsheet-holder further includes a first mating fastener on the first end of the member designed to removably attach the member to a first side of a frame of a bed, and a second mating fastener on the second end of the member designed to removably attach the elongated member to an opposite second side of a frame of a bed.

13 Claims, 6 Drawing Sheets

BEDSHEET-HOLDER

CROSS REFERENCE TO RELATED APPLICATION

This application claims the benefit of U.S. Provisional Application No. 62/578,088 filed on Oct. 27, 2017. The above identified patent application is herein incorporated by reference in its entirety to provide continuity of disclosure.

BACKGROUND OF THE INVENTION

The present invention relates to bedding materials and the securing thereof when in use on a mattress. More specifically, the present invention provides a plurality of fasteners distributed across an elongated strap that can be secured to the frame of a bed. The combination of the fasteners and the strap allows for whatever bedding materials are in use on the bed to be firmly secured on the bed while also making the arrangement of the bedding materials more convenient for the user or users.

Often during the night, bedding materials such as bed sheets, comforters, and blankets have a tendency to be dislodged, disheveled, and end up falling off the bed down onto the floor. During sleep one partner may pull the bedding over to their side of the bed, leaving the other individual without covering. This can cause the uncovered individual to be woken up during the night due to feeling cold and uncovered.

Additionally, making the bed in the morning can be a daunting task, particularly for children and seniors, because tucking the bedding under the mattress at the foot of the bed reduces the overall length of the bedding. As a result, the person making the bed will either have to tug at the bedding, which often dislodges the portion tucked under at the foot of the bed, or leave the portion of the mattress at the head of the bed uncovered. This problem is made doubly hard in instances where the bed is positioned up against a wall such that the side against the wall is inaccessible to the person making the bed.

The present invention provides a means for securing the bedding material without the need to tuck the bedding under the mattress at the foot of the bed. Therefore, there is a need in the art for a bedsheet holder configured to secure bedding in place and prevent it from falling off of the bed when in use.

Devices have been disclosed in the known art that relate to bedsheet-holders. These include devices that have been patented and published in patent application publications. These devices generally relate to high friction coatings along a portion of the bed frame that allow for bedding to be held in place through applied pressure. However, none of these devices utilize an interlocking frame with fasteners disposed along its length.

In light of the devices disclosed in the known art, it is submitted that the present invention substantially diverges in design elements from the known art and consequently it is clear that there is a need in the art for an improvement to existing bedsheet-holding devices. In this regard the instant invention substantially fulfills these needs.

SUMMARY OF THE INVENTION

In view of the foregoing disadvantages inherent in the known types of bedsheet-holders now present in the known art, the present invention provides a new bedsheet-holder wherein the same can be utilized for providing convenience for the user when sleeping in a bed, or when making a bed.

It is therefore an object of the present invention to provide a new and improved bedsheet-holding device that has all of the advantages of the known art and none of the disadvantages.

Another object of the present invention is to provide a bedsheet-holder, comprising an elongated flexible member having a first end and a second end, configured to secure a plurality of bedding materials in place.

Yet another object of the present invention is to provide a plurality of fasteners disposed along a longitudinal length of the elongated member, configured to secure the elongated member to the plurality of bedding materials, such that the plurality of bedding materials remain attached to one another and are prevented from falling off of a bed when in use.

A further object of the present invention is to provide a first mating buckle fastener disposed on the first end of the elongated flexible member, configured to removably attach the elongated member to a first side of a frame of a bed.

Another object of the present invention is to provide a second mating buckle fastener disposed on the second end of the elongated flexible member, configured to removably attach the elongated member to an opposite second side of a frame of a bed.

Yet another object of the present invention is to provide a bedsheet-holder wherein each of the plurality of fasteners are evenly disposed along the elongated member at fixed intervals relative to one another.

An additional object of the present invention is to provide a bedsheet-holder wherein each of the plurality of fasteners further include a spring biased clip including rubber teeth for receiving and retaining the plurality of bedding material therein.

Still another object of the present invention is to provide an elongated flexible member comprising a strapping material, such as polyester.

A further object of the present invention is to provide an elongated flexible member comprising a strapping material, such as nylon.

Another object of the present invention is to provide a bedsheet-holder that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
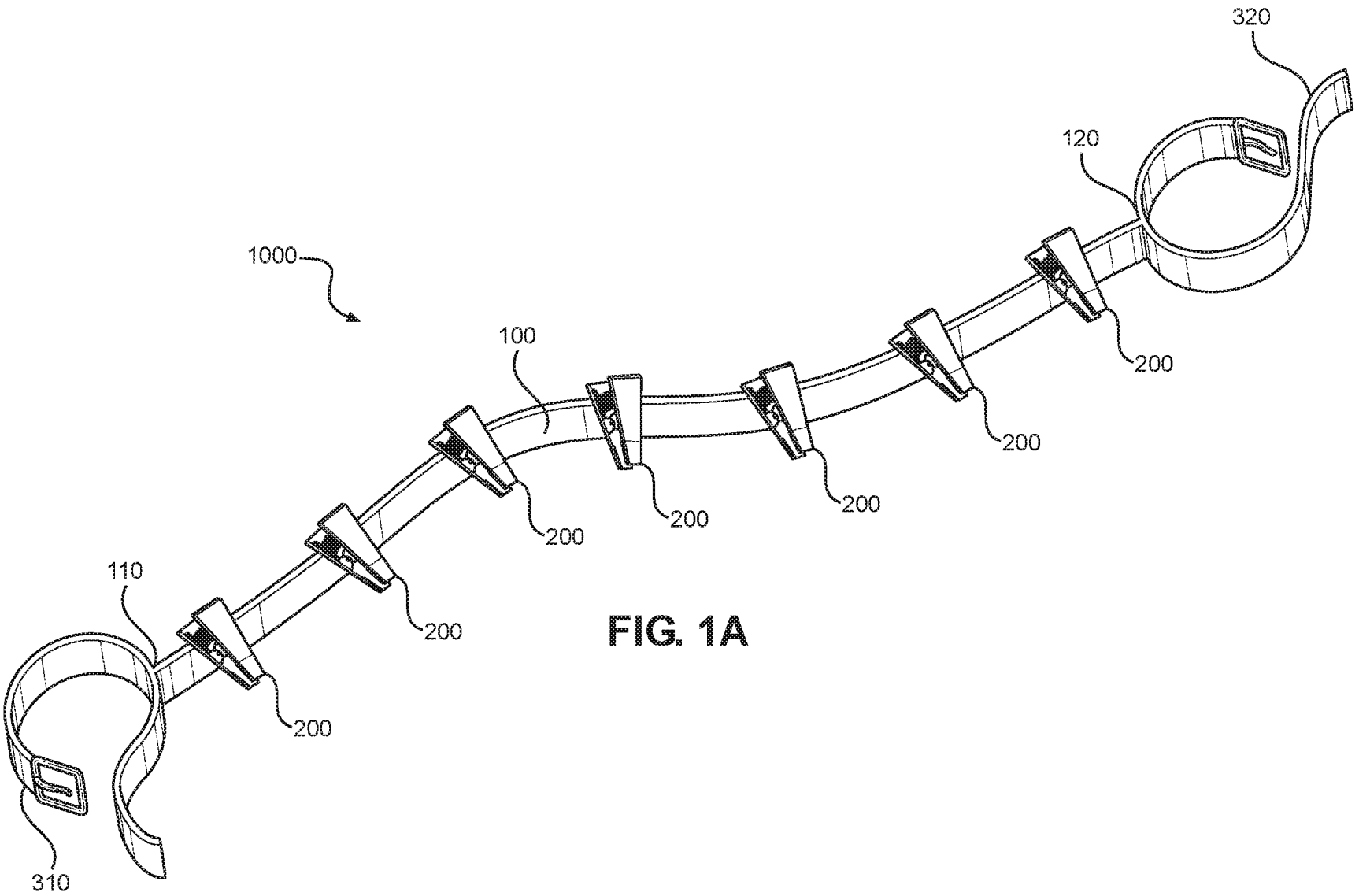
FIG. 1A shows a perspective view of an embodiment of a bedsheet-holder.

Reference is made herein to the attached drawings. Like reference numerals are used throughout the drawings to depict like or similar elements of the bedsheet-holder. For the purposes of presenting a brief and clear description of the present invention, the preferred embodiment will be discussed as used for securing bedding materials in place. The figures are intended for representative purposes only and should not be considered to be limiting in any respect.

Figure 1B:
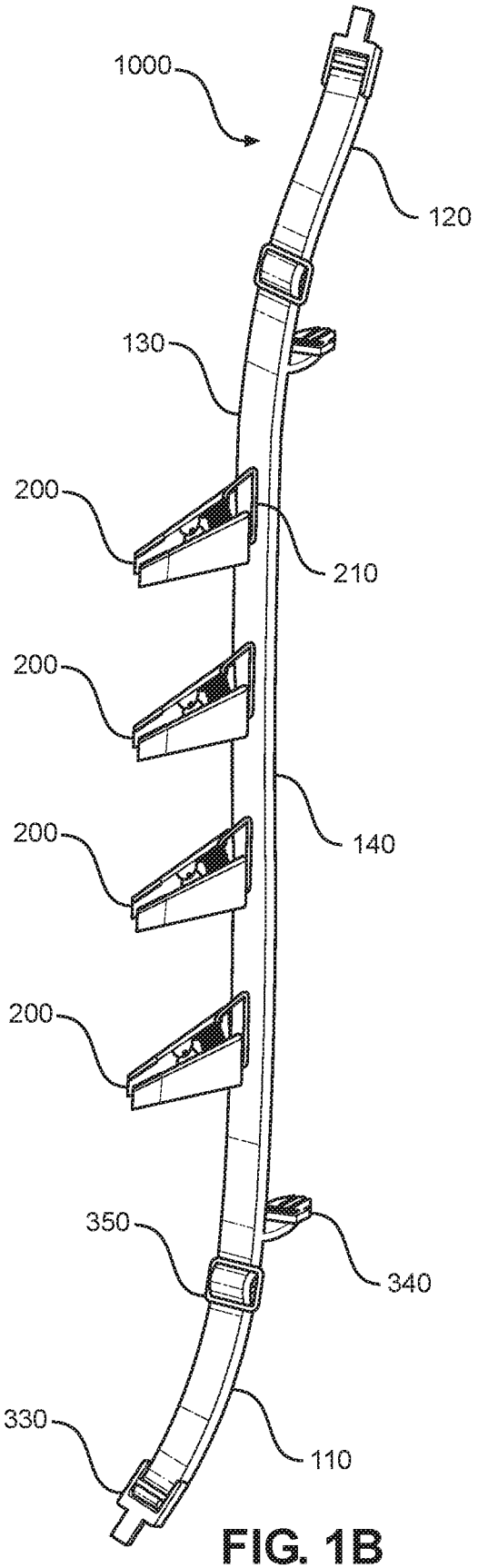
FIG. 1B shows a perspective view of an alternate embodiment of a bedsheet-holder.
Figure 2A:
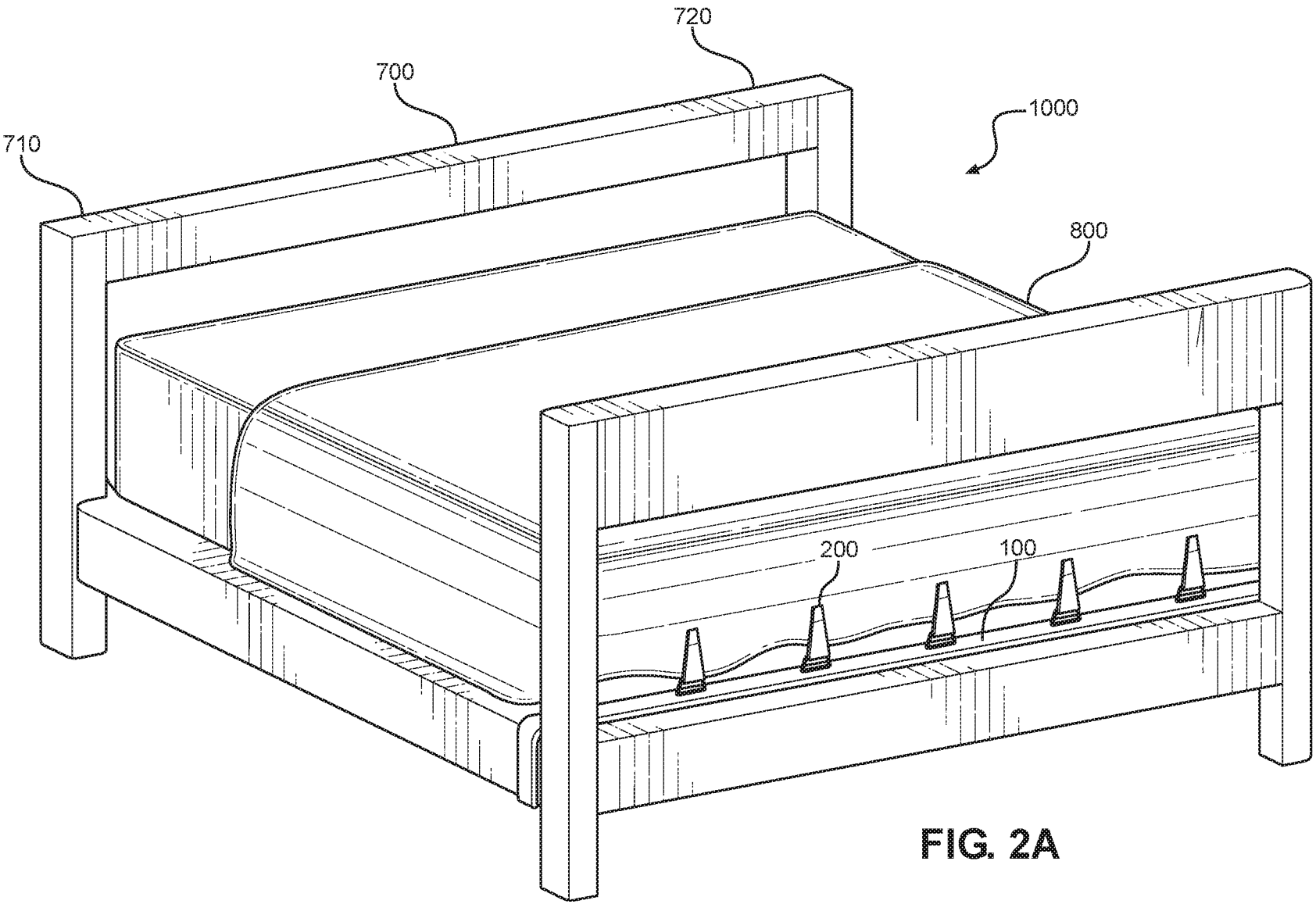
FIG. 2A shows a perspective view of an embodiment of a bedsheet-holder in use on a bed.

Referring now to FIGS. 1A and 1B, there are shown a perspective view of an embodiment of a bedsheet-holder, and a perspective view of an alternate embodiment of a bedsheet-holder, respectively. In the illustrated embodiment a bedsheet-holder 1000, comprises an elongated flexible member 100 having a first end 110 and a second end 120 configured to secure a plurality of bedding materials (as shown in FIG. 2A, 900) in place. A first mating fastener 310 is disposed on the first end 110, and a second mating fastener 320 is disposed on the second end 120, wherein the first and second mating fasteners are configured to removably secure the elongated flexible member 100 to a frame of a bed (as shown in FIG. 2A, 800). In the illustrated embodiment of FIG. 1B, the first and second mating fasteners 310, 320 comprise a buckle 330 disposed on each of the first and second ends 110, 120, and a complementary buckle receiver 340 disposed on a lower surface 140 of the elongated flexible member 100. The buckle 330 is configured to removably secure within the buckle receiver 340, such that the first and second ends 110, 120 can be secured about the frame. The elongated flexible member 100 comprises a length equal to or greater than a lateral width of a bed. In this way, the elongated flexible member 100 can extend across the foot of the bed, ensuring that the bedding materials remain tightly secured therealong. The bedsheet-holder 1000 is configured to both hold the plurality of bedding materials together with respect to one another so that they can be more easily maneuvered and arranged together on a bed and to hold the plurality of bedding materials in place with respect to the bed to ensure that the plurality of bedding materials do not become dislodged or fall off the bed when in use. In an alternate embodiment, the elongated flexible member 100 is adjustable in length along an adjustment member 350 disposed therealong.

In one embodiment a plurality of fasteners 200 is disposed along a longitudinal length of the elongated member 100 and configured to secure the elongated member 100 to the plurality of bedding materials. The plurality of fasteners 200 are uniformly disposed along the elongated member 100 at fixed intervals relative to one another. The uniform distribution of fasteners ensures that that the strength of the connection between the bedding materials and the elongated member 100 is equal at all points of contact, which thereby prevents uneven distribution of tension and reduces the instances of the bedding materials being pulled out of place or being dislodged from the bed when in use.

In the illustrated embodiment of FIG. 1B, a plurality of rings 210 are disposed along an upper surface 130 of a length of the elongated flexible member 100, wherein each of the plurality of fasteners 200 are affixed to the plurality of rings 210. In some embodiments, the plurality of fasteners 200 are rotatably and slidably secured to the plurality of rings 210, such that the user can adjust the position of the plurality of fasteners 200 therealong. Additionally, the plurality of rings 210 provide vertical displacement from the elongated flexible member 100 such that the plurality of fasteners 200 close the distance between a bed frame and the plurality of bedding materials 900. In this way, the movability of the plurality of fasteners 200 along the plurality of rings 210 further prevent the plurality of bedding materials 900 from pulling away from the plurality of fasteners 200 when the plurality of bedding materials 900 are moved during use.

Figure 2B:
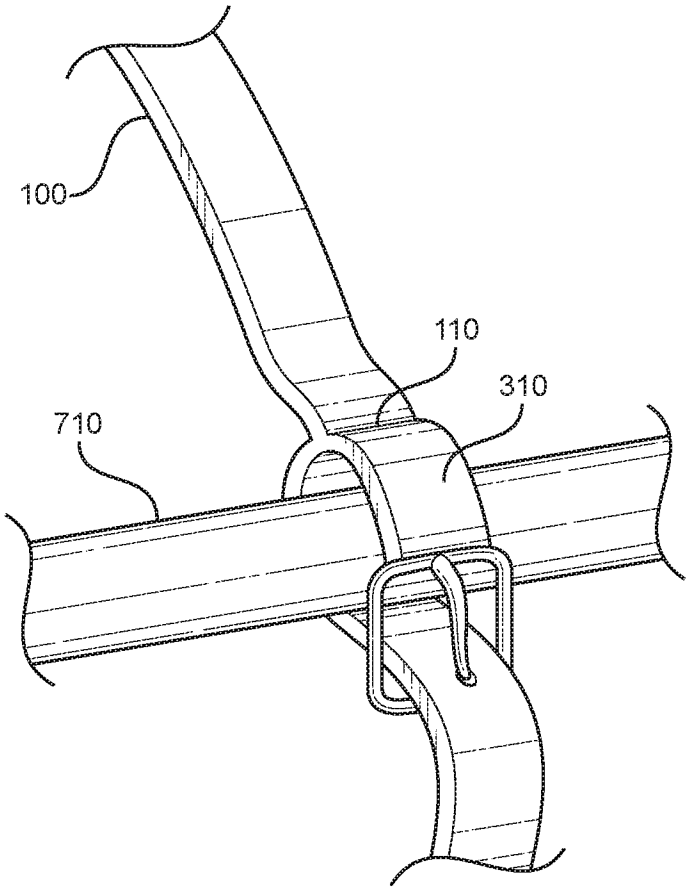
FIG. 2B shows a perspective view of a first mating buckle fastener in use being secured to a bedframe in an embodiment of a bedsheet-holder.
Figure 2C:
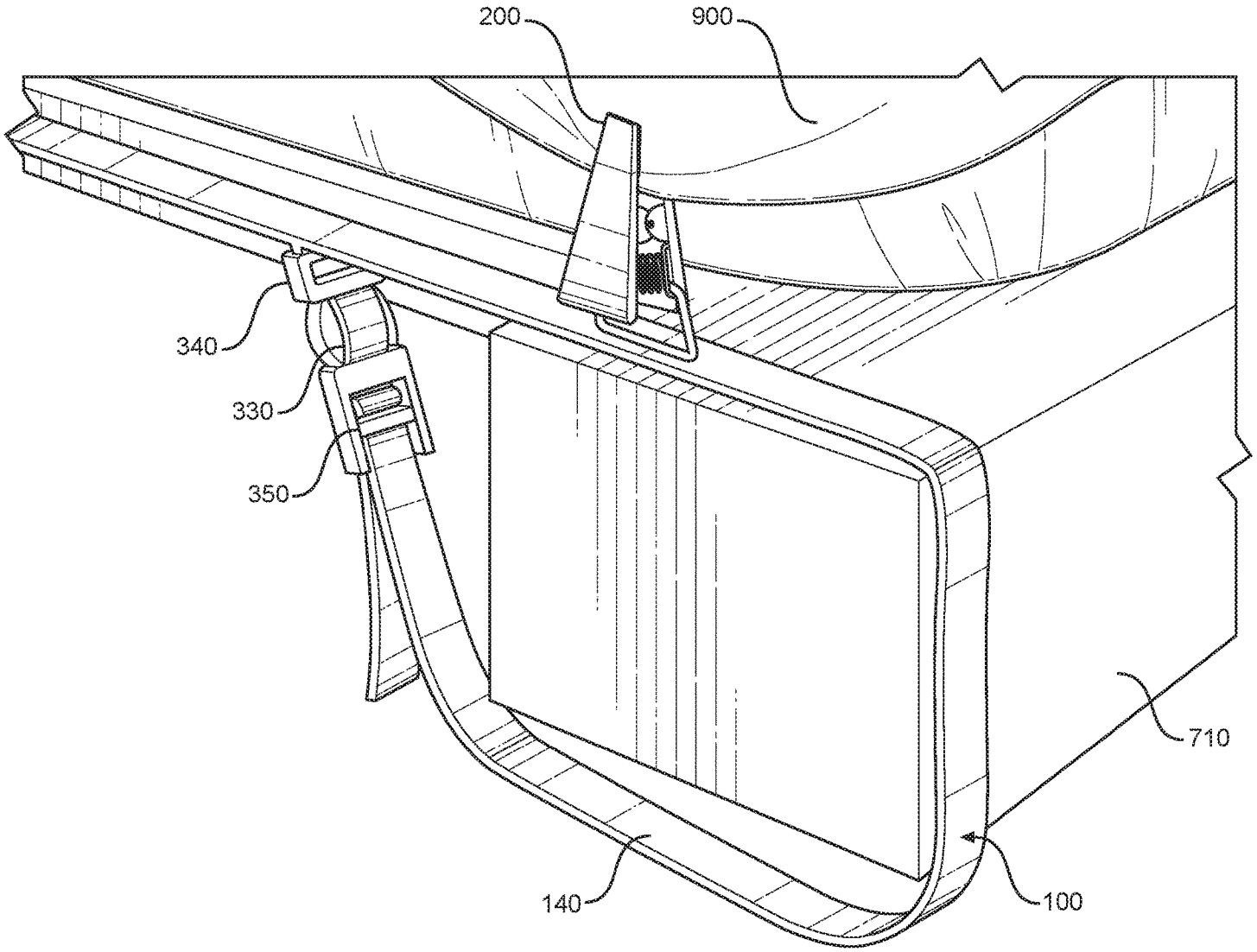
FIG. 2C shows a perspective view of a first mating buckle fastener in use being secured to a bedframe in an alternate embodiment of a bedsheet-holder.

Referring now to FIGS. 2A, 2B, and 2C, there are shown a perspective view of an embodiment of a bedsheet-holder in use on a bed, a perspective view of a first mating buckle fastener in use being secured to a bedframe in an embodiment of a bedsheet-holder, and a perspective view of a first mating buckle fastener in use being secured to a bedframe in an alternate embodiment of a bedsheet-holder, respectively. Additionally, in some embodiments, a first mating fastener 310 is disposed on the first end 110 of the elongated flexible member 100 and a second mating fastener 320 is disposed on the second end 120 of the elongated flexible member 100. The first mating fastener 310 is configured to removably attach the elongated member 100 to a first side 710 of a frame 700 of the bed 800. Similarly, the second mating fastener 320 is configured to removably attach the elongated member 100 to an opposite second side 720 of the frame 700 of the bed 800. In the illustrated embodiment, the first and second mating fasteners 310, 320 are secured at a head and foot of the bed 800, such that each side of the bedding materials 900 are secured therealong. Here the first and second mating fasteners 310, 320 are illustrated as buckles with adjustable straps, but in other embodiments the mating fasteners can be hook and loop fasteners or magnetized.

In the illustrated embodiment of FIG. 2C, the elongated flexible member 100 is removably secured about the first side 710 of the frame, such that the buckle 330 disposed on the end of the elongated flexible member 100 is removably secured within the buckle receiver 340 disposed on the lower surface 140. The length of the elongated flexible member 100 can then be adjusted via the adjustment mechanism 350, such that the lower surface 140 rests flush against the frame, thereby securing the elongated flexible member 100 to the bed. The user can then secure the plurality of bedding materials 900 within the plurality of fasteners 200 such that the plurality of bedding materials 900 are secured in a desired position relative to the bed. In one exemplary use, the user can secure the elongated flexible member 100 to the frame along a footboard of the bed, such that the plurality of bedding materials 900 are secured therealong, thereby replicating a bed having the bedding materials 900 tucked between the mattress and box spring, while more securely holding the bedding materials 900 in a desired position.

In operation, the fasteners 200 are secured to the bedding materials 900 and the first mating fastener 310 is secured to the first side 710 of the bed frame and the second mating fastener 320 is secured to the second side 720 of the bed frame. Once secured, the user is ensured that the plurality of bedding materials 900 are not significantly displaced during sleep, thereby allowing a user to easily make the bed after use, or ensure that the bedding materials 900 are not removed during the night.

Figure 3A:
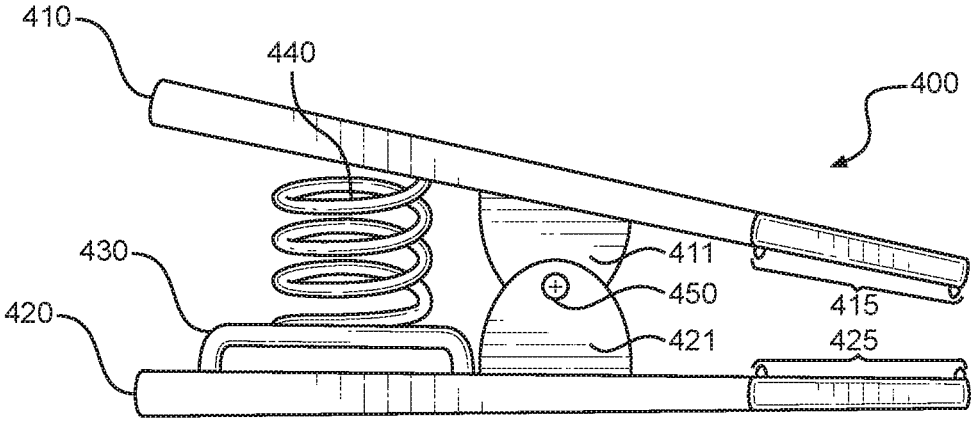
FIG. 3A shows a sideview of a spring-biased clip in an embodiment of a bedsheet-holder.
Figure 3B:
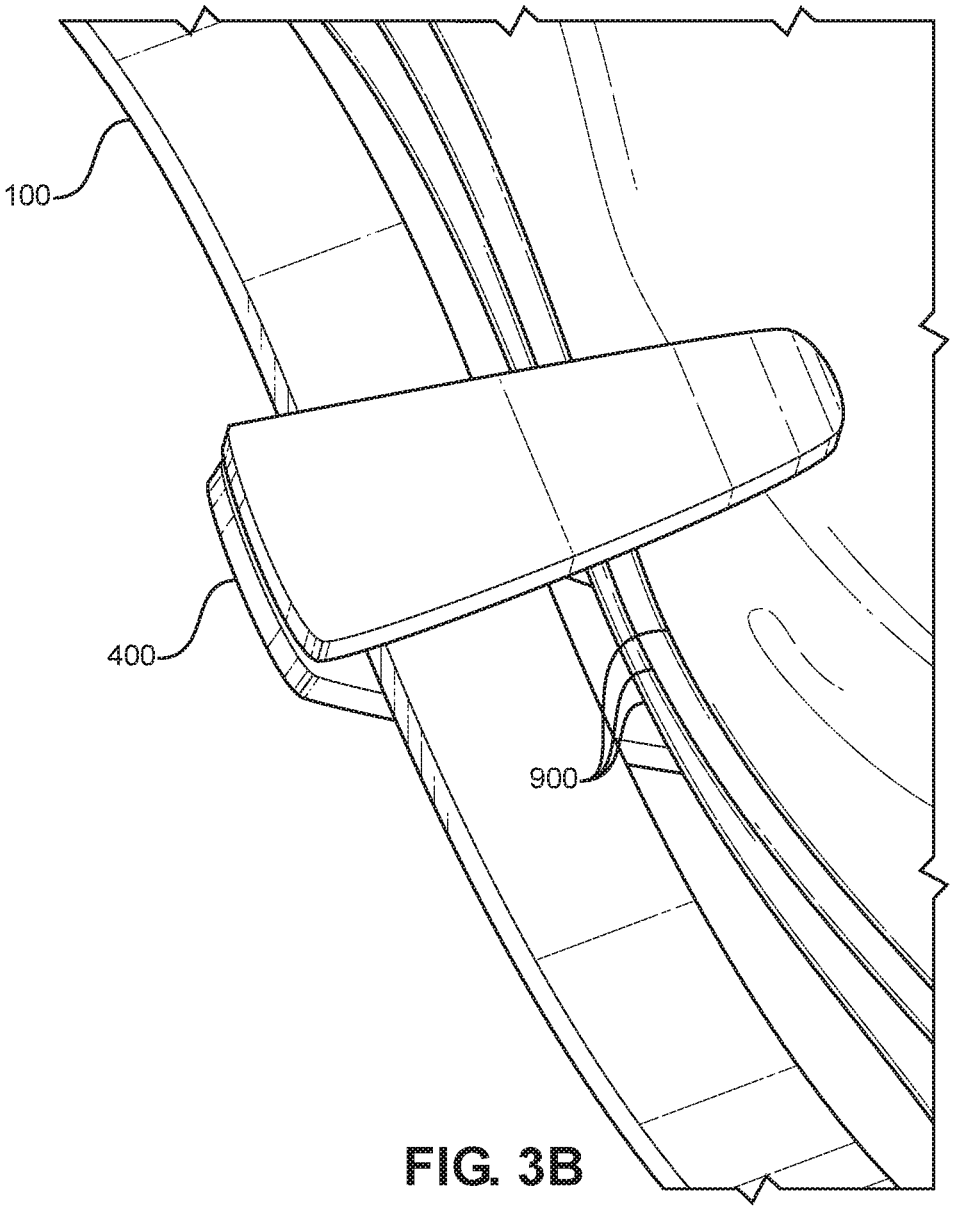
FIG. 3B shows a perspective view of a spring-biased clip from an embodiment of a bedsheet-holder in use securing bedding materials together.

Referring now to FIGS. 3A and 3B, there are shown a sideview of a spring-biased clip in an embodiment of a bedsheet-holder and a perspective view of a spring-biased clip from an embodiment of a bedsheet-holder in use securing bedding materials together, respectively. In the illustrated embodiment each of the plurality of fasteners 200 further includes a spring biased clip 400 having an upper end 410, and a lower end 420 that are interconnected by a pivotal joint 450. In the illustrated embodiment, the pivotal joint 450 comprises a first joint member 411 affixed to an interior surface of the upper end 410, and a second joint member 421 affixed to an interior surface of the lower end 420, wherein the first and second joint members 411, 421 are pivotally affixed to each other about the pivotal joint 450. In the illustrated embodiment, the first and second joint members 411, 421 comprise semi-circular cross-sections, such that the first and second joint members 411, 421 are configured to pivot tangentially along a perimeter thereof. The lower end 420 further includes a slot 430 sized and proportioned to allow the elongated flexible member 100 to be inserted therethrough. The slot 430 is configured to allow for each of the plurality of fasteners to slide along the length of the elongated flexible member, such that the position of each fastener can be adjusted to best suit the needs of the bed and bedding materials 900 being secured. In an alternate embodiment, the slot 430 is configured to receive one of the plurality of rings therethrough, such that the fastener is slidable and rotatable about the ring via the slot 430. In this way, the user is provided additional maneuverability, such that some movement of the plurality of bedding materials 900 is allowed without removing the plurality of bedding materials 900 from the plurality of fasteners.

The illustrated embodiment also shows where the upper end 410 includes a first plurality of clamping teeth 415 and the lower end 420 includes a second plurality of clamping teeth 425, such that a spring 440 exerts an expansive force that presses the first plurality of clamping teeth 415 and second plurality of clamping teeth 425 toward one another. When pressed together the first plurality of clamping teeth 415 and second plurality of clamping teeth 425 receive and retain the plurality of bedding materials 900 therein. In some embodiments, the first and second plurality of clamping teeth 415, 425 comprise a rubber coating thereon, such that the first and second plurality of clamping teeth 415, 425 frictionally engage the plurality of bedding materials 900 therebetween. Furthermore, in the illustrated embodiment the elongated flexible member 100 comprises a strapping material, such as polyester. In other embodiments the elongated flexible member 100 can a strapping material, such as nylon.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bedsheet-holder, comprising:

an elongated flexible member having a first end and a second end is configured to secure a plurality of bedding materials in place;

a plurality of fasteners disposed along a longitudinal length of the elongated member is configured to secure the elongated member to the plurality of bedding materials, such that the plurality of bedding materials remain attached to one another and are prevented from falling off of a bed when in use;

a first mating buckle fastener disposed on the first end of the elongated flexible member is configured to removably attach the elongated member to a first side of a frame of a bed;

a second mating buckle fastener disposed on the second end of the elongated flexible member is configured to removably attach the elongated member to an opposite second side of a frame of a bed.

2. The bedsheet-holder of claim 1, wherein each of the plurality of fasteners are evenly disposed along the elongated member at fixed intervals relative to one another.

3. The bedsheet-holder of claim 1, wherein each of the plurality of fasteners further includes a spring biased clip including rubber teeth for receiving and retaining the plurality of bedding material therein.

4. The bedsheet-holder of claim 1, wherein the elongated flexible member comprises a strapping material, such as polyester.

5. The bedsheet-holder of claim 1, wherein the elongated flexible member comprises a strapping material, such as nylon.

6. The bedsheet-holder of claim 1, wherein each of the plurality of fasteners comprise a slot that receives the elongated flexible member therethrough.

7. The bedsheet-holder of claim 6, wherein the plurality of fasteners are slidably engaged with the elongated flexible member about the slot.

8. The bedsheet-holder of claim 1, wherein the elongated flexible member comprises a length equal to or greater than a lateral width of the bed.

9. The bedsheet-holder of claim 1, wherein the first and second mating buckle fasteners comprise a buckle disposed on the first end and the second end, respectively, and a complementary buckle receiver disposed on a lower surface of the elongated flexible member at each of the first and second ends.

10. The bedsheet-holder of claim 9, wherein the lower surface is configured to rest flush against the frame when secured thereto.

11. The bedsheet-holder of claim 1, further comprising a plurality of rings disposed along an upper side of the elongated flexible member, wherein the plurality of fasteners are secured to the plurality of rings.

12. The bedsheet-holder of claim 1, wherein a length of the elongated flexible member is adjustable.

13. A bedsheet-holder, consisting of:

an elongated flexible member having a first end and a second end is configured to secure a plurality of bedding materials in place;

a plurality of fasteners disposed along a longitudinal length of the elongated member is configured to secure the elongated member to the plurality of bedding materials, such that the plurality of bedding materials remain attached to one another and are prevented from falling off of a bed when in use;

wherein the elongated flexible member comprises a length equal to or greater than a lateral width of the bed;

wherein each of the plurality of fasteners comprise a slot that receives the elongated flexible member therethrough;

a first mating buckle fastener disposed on the first end of the elongated flexible member is configured to removably attach the elongated member to a first side of a frame of a bed;

a second mating buckle fastener disposed on the second end of the elongated flexible member is configured to removably attach the elongated member to an opposite second side of a frame of a bed.

* * * * *